United States Patent [19]

Mick et al.

[11] Patent Number: 4,555,032

[45] Date of Patent: Nov. 26, 1985

[54] HEAVY LIFT CRANE

[75] Inventors: Jon L. Mick, Cedar Rapids, Iowa; Marvin L. Wolf, Houston, Tex.

[73] Assignee: FMC Corporation, Chicago, Ill.

[21] Appl. No.: 478,193

[22] Filed: Mar. 24, 1983

[51] Int. Cl.[4] ..... B66C 23/78; B66C 23/72

[52] U.S. Cl. ..... 212/189; 180/8.1; 180/8.5; 180/116; 212/195

[58] Field of Search ..... 212/189, 223, 175, 177, 212/180–183, 226–227, 231–232, 237, 244, 255, 260, 263; 180/8.1, 8.5, 116

[56] References Cited

U.S. PATENT DOCUMENTS

| | | | |
|---|---|---|---|
| 1,001,299 | 8/1911 | Page | 180/8.1 |
| 2,452,632 | 11/1948 | Cameron | 37/116 |
| 2,914,127 | 11/1959 | Ricouard | 180/8.5 |
| 3,239,022 | 3/1966 | Dolphin | 180/116 |
| 3,446,301 | 5/1969 | Thomas | 180/8.5 |
| 3,512,597 | 5/1970 | Baron | 180/8.5 |
| 3,576,225 | 4/1971 | Chambers | 180/8.5 |
| 3,836,010 | 9/1974 | Lampson | 212/49 |
| 3,868,022 | 2/1975 | Greenlay | 212/48 |
| 4,036,377 | 7/1977 | Weber | 180/116 |
| 4,170,309 | 10/1979 | Lampson | 212/48 |
| 4,243,148 | 1/1981 | Lampson | 212/196 |
| 4,258,852 | 3/1981 | Juergens | 212/178 |
| 4,358,021 | 11/1982 | Helm et al. | 212/195 |

FOREIGN PATENT DOCUMENTS

| | | |
|---|---|---|
| 1180502 | 10/1964 | Fed. Rep. of Germany . |
| 1246969 | 8/1967 | Fed. Rep. of Germany . |
| 6405689 | 11/1965 | Netherlands . |

*Primary Examiner*—Trygve M. Blix
*Assistant Examiner*—R. B. Johnson
*Attorney, Agent, or Firm*—A. J. Moore; H. M. Stanley; R. B. Megley

[57] ABSTRACT

A heavy lift transi-crane supported on a substantially flat surface is disclosed which includes a boom supporting unit having a rigid annular foot, with the boom supporting unit being connected to a propelling unit by an elongated rigid connecting link. A substantial portion of the weight acting on the boom supporting unit is carried by fluid under pressure contacting a large area of the flat surface within the rigid annular foot but with the force being insufficient to raise the annular foot from the surface thereby greatly reducing frictional forces between the foot and the surface and the power requirements to move the transi-crane. The propelling unit is preferably a multi-directional walking beam vehicle which is capable of moving the transi-crane along a linear path or around a vertical pivot axis of the boom supporting unit.

1 Claim, 7 Drawing Figures

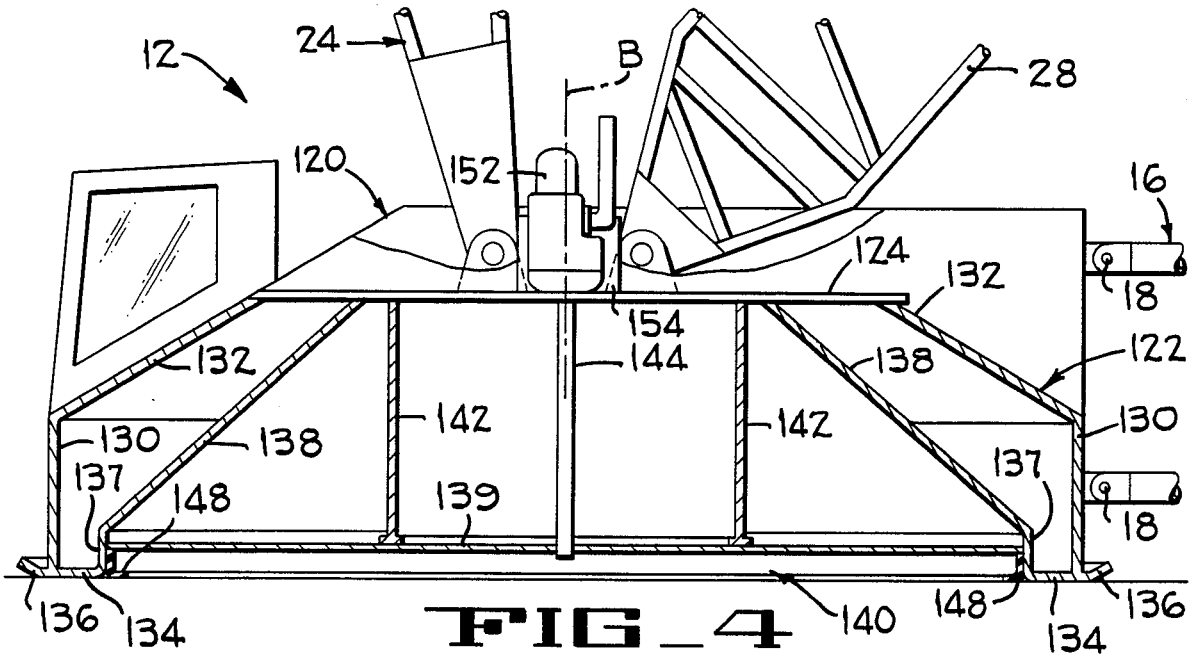
FIG_4
FIG_5
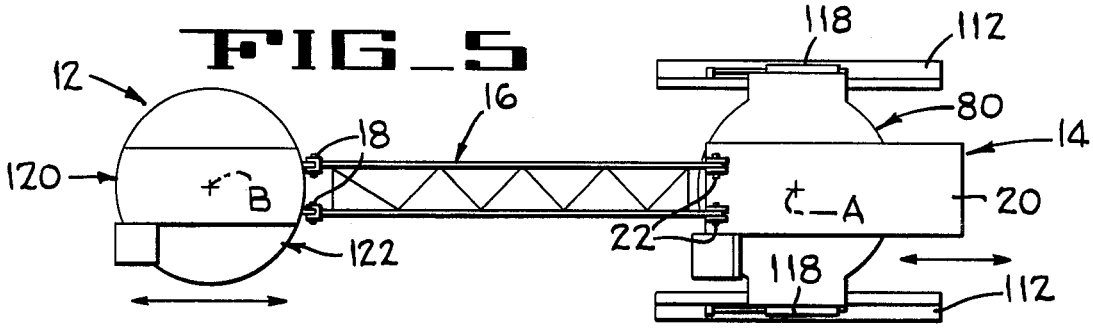
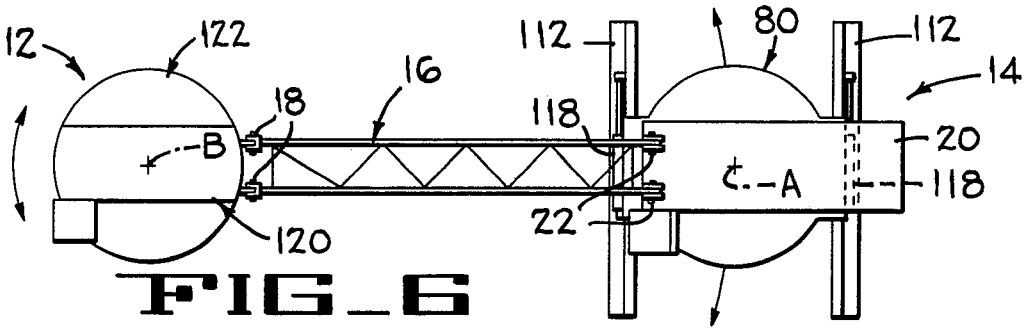
FIG_6
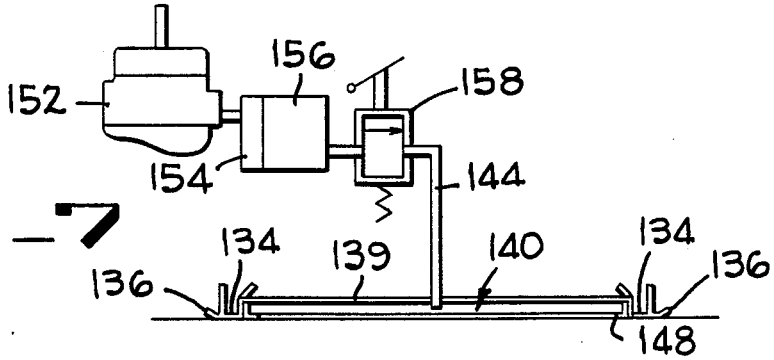
FIG_7

HEAVY LIFT CRANE

CROSS REFERENCE TO RELATED APPLICATIONS

The present invention is pertinent to the inventions disclosed in the following copending applications assigned to the assignee of the present invention and filed on even date herewith.

Mick. Appln. Ser. No. 478,195 entitled Steerable Carrousel Supported Walking Beam Vehicle, which issued as U.S. Pat. No. 4,519,468 on May 28, 1985.

Wolf Appln. Ser. No. 478,194 entitled Load Supporting Structure, which issued as U.S. Pat. No. 4,520,888 on June 4, 1985.

BACKGROUND OF THE INVENTION

1. Field of the Invention

The present invention relates to cranes or the like and more particularly relates to heavy lift cranes having interconnected boom supported and propelling units and being capable of lifting and carrying 600 tons or more while requiring a minimum of power.

2. Description of the Prior Art

Cranes or the like having interconnected boom supporting and propelling units are disclosed in U.S. Pat. Nos.: McL Cameron 2,452,662; Lampson 3,836,010; Greenlay et al 3,868,022. German Pat. Nos. 1,180,502 and 1,246,969; and Netherlands Pat. No. 64/5689 also disclose similar types of cranes. However, the complexities and large number of moving parts in the prior art cranes, as compared to the crane of the present invention, are costly, require frequent and costly maintenance, and also require more power during operation than is required by the crane.

SUMMARY OF THE INVENTION

The apparatus of the present invention provides a crane that includes powered interconnected boom supporting and propelling units which are capable of moving the crane along linear paths or about the vertical axis of the boom supporting unit without the aid of ground engaging rolling members such as wheels or endless tracks. The crane includes a powered boom supporting unit which is supported by an annular ring at all times but with a substantial majority of the weight applied to the supporting unit being supported by air pressure thus permitting a minimum of power for moving the crane from place to place. The powered propelling unit which moves the crane includes a walking beam mechanism and a bifunctional swing drive system. The swing drive system provides either rotation of the walking beams relative to the upper support and ground, or rotation of the upper support relative to the walking beams and ground.

BRIEF DESCRIPTION OF THE DRAWINGS

FIG. 4 is an enlarged side elevation of the boom suporting unit with parts cut away for illustrating the internal construction of the air supporting unit and diagrammatically illustrating a powered air pumping system.

FIGS. 5 and 6 are schematic operational views illustrating two directions of movement in which the crane can be moved.

FIG. 7 is a diagrammatic pneumatic diagram for controlling air pressure within the crane supporting unit.

DESCRIPTION OF THE PREFERRED EMBODIMENT

Figure 1:
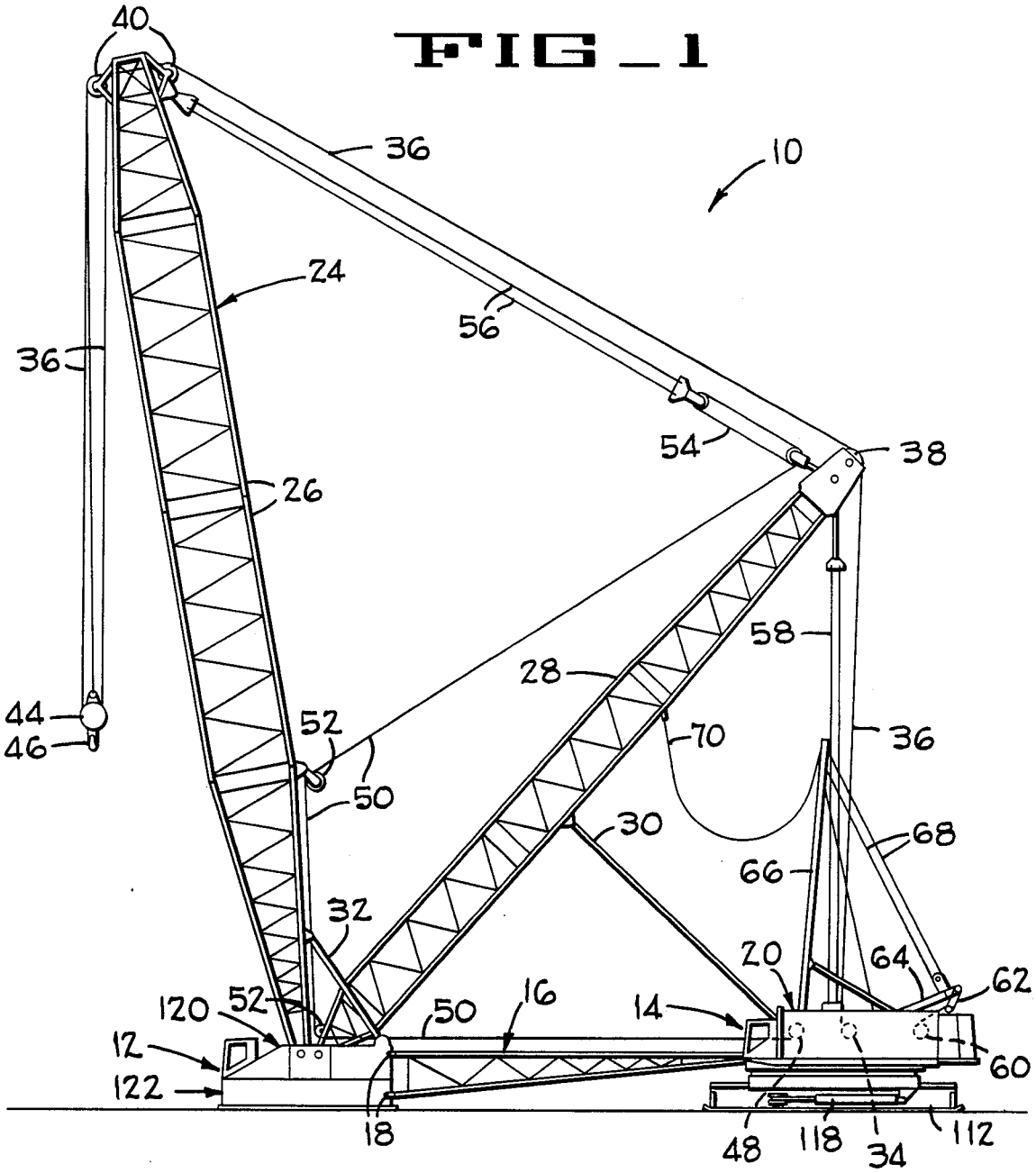
FIG. 1 is a side elevation of the crane of the present invention.

The heavy lift crane 10 of the present invention comprises a boom supporting unit 12 and a crane propelling unit 14 which are interconnected by a rigid interconnecting link 16. The link 16 is rigidly secured to the supporting unit 12 by pins 18 (FIGS. 1 and 4); and is connected for horizontal pivotal movement to the upper works 20 of the propelling unit 14 by pivot pins 22.

The boom supporting unit 12 pivotally supports a lattice boom 24 (FIGS. 1 and 4) which may be extended by adding one or more boom sections 26 in a conventional manner. A mast 28 is pivotally supported by the supporting unit 12 but is held in substantially fixed position during operation by a mast stop 30 that is connected between the mast and the upper works 20 of the propelling unit 14. A boom stop 32 is connected between the boom 24 and the supporting unit 12 and prevents the boom from pivoting rearwardly beyond the vertical while allowing the boom to pivot forwardly.

A load winch 34 in the upper works has a load line 36 trained around sheaves 38, 40 and 44 on the mast 28, boom 24 and a hook block 46, respectively, for engaging and lifting a load. A boom winch 48 in the upper works 20 includes a live boom hoist rope 50 which extends horizontally above the connecting link 16, then upwardly around guide sheaves 52 and onto multiple sheaves of a live boom hoist 54. The hoist 54 is connected to the mast 28 and to the upper end of the boom 24 by pendants 56. Backstays Pendants 58 are connected to the upper end of the mast 28 and to the upper works 20 to limit counterclockwise movement of the mast 28 during normal operation to the position illustrated in FIG. 1. A third winch 60 is provided in the upper works 20 and is connected by a conventional bail assembly 62 to a live mast 64 which is connected to a boom erecting mast 66 and to the main mast 28 by pendants 68 and 70 for raising or lowering the main mast 28. It will be understood that an engine and hydraulic pump (not shown) are mounted in the upper works and are hydraulically connected to conventional controls and to winches 34,48 and 60; and to other hydraulic components on the propelling unit 14 to be described hereinafter.

The ground engaging portion or lower works 80 (FIG. 2) of the crane propelling unit 14 is disclosed herein, and is also disclosed in more detail in cross-referenced copending application Ser. No. 478,195, which application is incorporated by reference herein.

Figure 2:
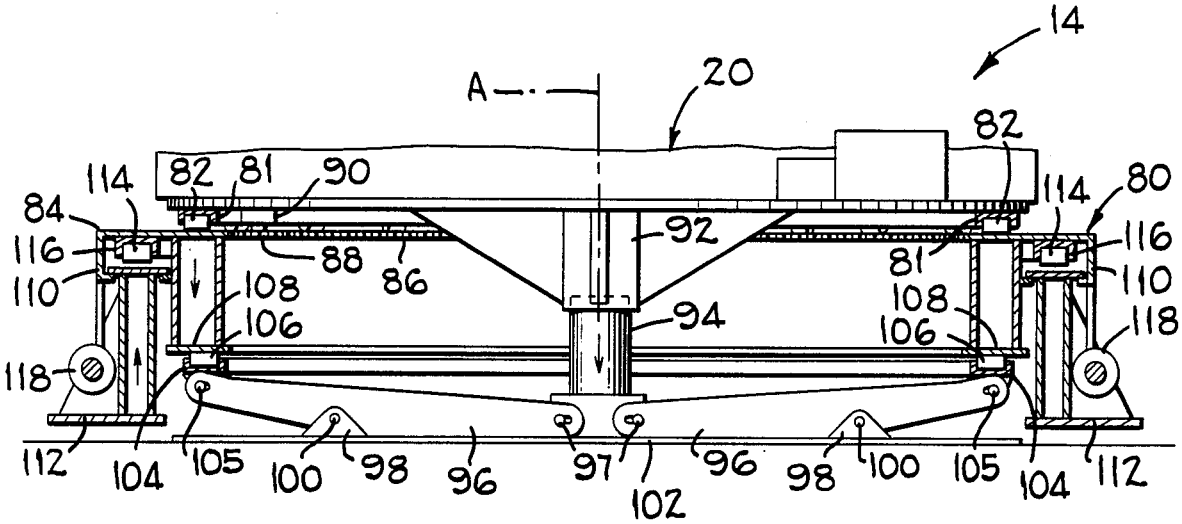
FIG. 2 is an enlarged vertical central section of the walking beam portion of the propelling unit illustrating the walking beams in an elevated position.

The upper works 20 (FIGS. 2 and 3) includes an annular channel 81 having a plurality of rollers 82 therein that rotate on the upper surface of a lower frame 84. The lower frame includes a large diameter internal ring gear 86 which is in meshing engagement with a pinion 88 that is secured to the output shaft of a hydraulic motor 90 secured to the upper works 20. A hydraulic lift cylinder 92 is rigidly connected to the upper works 20 and is coaxial with the axis A of the ring gear 86. A piston 94 extends downwardly from the cylinder 92 and is movably connected to the inner ends of a plurality of arms 96 (only two being shown) by pins 97 and slots. The arms are pivoted by yokes 98 and pins 100 to a lift pad 102 that is in the shape of a large diameter disc. The outer ends of the arms 96 are movably connected to an annular channel 104 by pins 105 and slots. The channel 104 has a plurality of rollers 106 therein which rotatably engage the lower surface of a rigid ring 108 which forms a portion of the lower frame 84. The lower frame also includes means defining diametrically opposed, parallel guideways 110 which slidably engage the upper ends of a pair of walking beams 112 when raised above the ground as illustrated in FIG. 2. Rollers 114 are journaled in linear channels 116 into the guideway 110 and rotatably support the upper works 20 and lower works 80 on the walking beams 112 when the lifting pad 102 is lifted off the ground as illustrated in FIG. 3.

A pair of hydraulic cylinders 118 (FIGS. 1–3) are connected between the associated walking beams 112 and the lower works 80.

When the walking beams 112 are raised clear of the ground by actuation of the hydraulic cylinder 92 and the propelling unit is supported by the lifting pad 102 as shown in FIG. 2, it is apparent that the crane operator may control the flow of hydraulic fluid into the hydraulic motor 90 to pivot the walking beam relative to the upper works and to the ground. It will be apparent from FIG. 2 that the arms engage the lifting pad between the piston and the pivot pins 100 thereby distributing the weight of the propelling unit over substantially the full area of the lifting pad 102.

Figure 3:
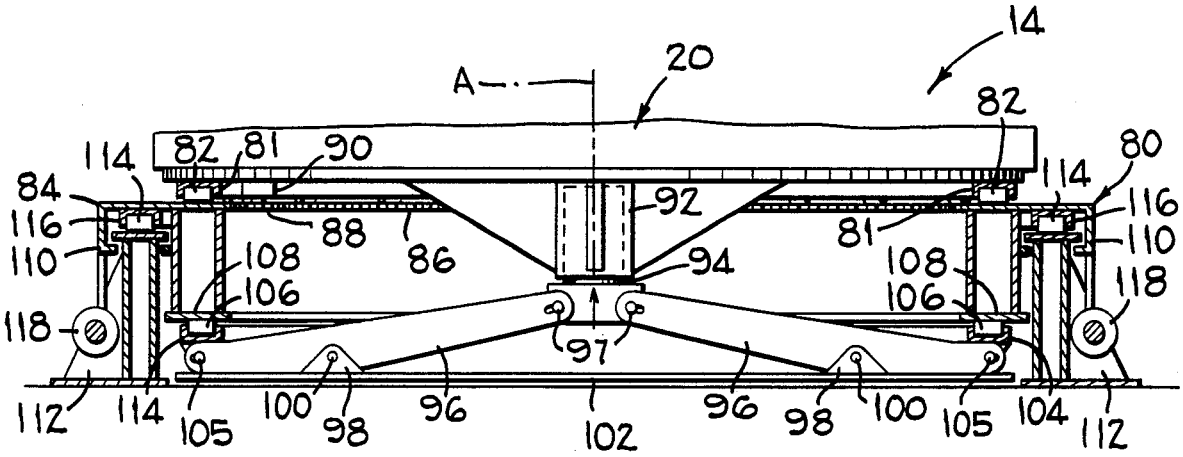
FIG. 3 is an elevation similar to FIG. 2 but with the walking beams supporting the propelling unit.

When the hydraulic cylinder 92 is actuated to raise the lifting pad 102 from the ground as illustrated in FIG. 3, it will be apparent that the operator may actuate the motor 90 to rotate the pad 102 and the upper works 20 in either direction relative to the ground.

In order to drive the crane 10 in a linear direction, the operator actuates controls (not shown) for reciprocating the walking beams 112 to the forward ends of their stroke when the beams are raised from the ground. The operator then actuates hydraulic controls to lower the walking beams to the ground and raise the lifting pad 102, and thereafter actuates the cylinders 118 in a reverse direction to move the transi-crane 10 forward one step. These steps are thereafter repeated until the crane is moved to the desired position.

The boom supporting unit 12 (FIG. 4) comprises a boom supporting upper frame 120 which is rigidly secured to a ground supporting lower frame 122.

The lower frame 122 comprises an upper plate 124, which supports the upper frame 120 and a cylindrical outer wall 130 that is generated about an axis B. The upper plate 124 is connected to the cylindrical sidewall 130 by a downwardly inclined frusto-conical wall 132. The lower end of the wall 130 is connected to a rigid annular foot 134 which includes an upturned outer lip 136 which at all time engages the ground during operation and aids the sliding movement of the boom supporting unit 12 over the ground during movement of the crane to a different location. An inner cylindrical wall 137 and a frusto-conical wall 138 also connects the upper plate 124 to the annular foot 134. An upper wall 139 of a shallow pressure chamber 140 is connected in airtight relationship to the wall 137. A cylindrical wall 142 and an air conduit 144 which communicates with the air chamber 140, are secured to the plate 124 and to the upper wall 139 to reinforce the wall 138 from bowing upwardly due to air pressure. A flexible seal 148 of generally L-shaped cross section is secured to the inner wall 137 and engages the ground for sealing the pressure chamber 140 to the ground when air is directed into the chamber 140 through the air inlet conduit 144.

As diagrammatically illustrated in FIGS. 4 and 7, an engine 152, an air compressor or blower 154 and a tank 156 are provided for supplying air to the pressure chamber 140 in response to an operator opening a valve 158. The operator provides sufficient pressure to support substantially all the load acting on the boom supporting unit 12, but not enough to lift the annular foot 134 off the ground thus preventing inadvertent tipping of the boom supporting unit 12.

Although it is preferred that the lower works is of generally cylindrical shape as indicated above, it is apparent that the lower works may be formed in other shapes, for example, in a rectangular shape if desired. It will also be understood that the term "ground" is intended to include other flat surfaces such as concrete, asphalt, and metal plates or the like.

In operation, if it is desired to move the heavy lift crane 10 along a linear path in either direction, whether carrying a load or not, the walking beams 112 are oriented parallel to the interconnecting link 16 as indicated in FIG. 5. The operator then actuates conventional controls (not shown) to start the engine 152 (FIGS. 4 and 7) on the boom supporting unit 12 which drives the blower 154 to direct high pressure air into the pressure chamber 140. The pressure chamber 140 uses the ground as one wall thereof, and is quite shallow but provides a very large ground area against which high pressure air acts to support the load. Accordingly, the volume and the pressure of the air needed to support the loads are relatively low.

In order to provide sufficient pneumatic supporting forces in the pressure chamber 140, it is apparent that the area of the ground within the annular foot 134 and its flexible seal 148 multiplied by the air pressure will provide the force necessary to support the desired amount of the load acting on the boom supporting unit 12. It will also be understood that the annular foot is at all times during operation in contact with the ground thus preventing tipping of the boom supporting unit 12 and its upper structure. This construction is to be distinguished from an air film bearing since there is no intentional or uncontrolled escape of air and the air pressure does not supply the total support of the boom supporting unit 12 and load thereon.

The specific internal diameter of the annular foot 134 and its flexible seal 148 will of course be determined by the maximum intended load to be carried, and a desirable air pressure range. In order to determine an acceptable foot diameter, it is believed that a dimensional comparison of the subject transi-crane 10 with a prior art conventional crane designed to support an 800 ton load would be helpful.

In this regard, assignee has designed a heavy duty crane having an 800 ton load carrying capacity which crane includes a single power unit propelled by endless tracks and includes a boom supporting frame that is pivoted about a vertical axis. The frame includes wheels that are rotatably supported on a 70 foot diameter ground supported ring for permitting arcuate movement of the load about the axis of the ring. It is apparent that this prior art crane cannot be moved along a linear path unless its load and counterweight are first removed and the frame supporting wheels are raised from the ground, and thereafter lowered onto the same or another 70 foot ring at a new location. The above crane is disclosed in Wittman et al U.S. Pat. No. 4,394,911 entitled Heavy Lift Crane.

If the annular foot 134 and flexible seal 148 of the crane 10 has a 70 foot internal diameter, an air pressure less than 3 pounds per square inch is required to support a total load (which includes the weight of the unit and upper structure supported thereby) weighing 800 tons. If a 30 foot internal diameter is used, less than 16 pounds per square inch is required; if a 20 foot internal diameter is used less than 36 pounds per square inch is required; and if a 15 foot internal diameter is used less than 63 pounds per square inch is required for supporting the total load of 800 tons.

As diagrammatically illustrated in FIG. 7, the engine 152, air blower 154 with its tank 156 are responsive to the opening of the valve 158 to provide and maintain the desired air pressure in the pressure chamber 140 thereby permitting the previously described power unit 14 to move the crane 10 in either direction along a linear path as illustrated in FIG. 5. Since the boom 24 at all times, projects parallel to the link 16 and forwardly, i.e., to the left (FIG. 5) it will be appreciated that the interconnecting link and the propelling unit 14 serve to stabilize and counterbalance the boom and thus minimizes the need for a very large diameter annular foot 134.

If it is desired to pivot the boom supporting unit 12 about its axis B in order to arcuately move a load to a different position, or in order to change the direction of linear movement of a crane 10, the operator first pivots the propelling unit 14 to the position illustrated in FIG. 6 and then drives the unit 14 arcuately about the axis B by means of the walking beams 112 to the desired position all as previously described.

From the foregoing description it is apparent that the heavy lift crane of the present invention includes a walking beam type propelling unit which includes a bifunctional swing drive system which requires a minimum of power for pivoting the walking beams relative to the upper support and ground, or pivots the upper support relative to the walking beams and the ground. The walking beam propelling unit is coupled to a boom supporting unit by an interconnecting link, with the boom supporting unit and its load primarily supported by air pressure thereby minimizing propulsion or requirements for moving the crane and without a reduction in stability or resistance to tipping. Also, neither the walking beam propelling unit nor the boom supporting unit requires costly ground engaging rotatable units such as wheels or endless tracks.

Although the best mode contemplated for carrying out the present invention has been herein shown and described, it will be apparent that modification and variation may be made without departing from what is regarded to be the subject matter of the invention.

What is claimed is:

1. A heavy lift crane or the like adapted to be moved along a substantially flat surface comprising:

means defining a boom supporting unit mounted on the flat surface for movably supporting a crane superstructure including;

means defining a single rigid annular foot for supporting and stabilizing said unit on said substantially flat surface and being centered about a vertical axis and being of sufficient external dimension to encompass said unit, means cooperating with said annular foot and a portion of the flat surface that is encompassed within said annular foot for defining a low volume large area pressure chamber, controllable fluid supply means for directing fluid under pressure into said pressure chamber at least during movement of said boom supporting unit relative to said flat surface with sufficient pressure for supporting a substantial portion of the weight acting on the boom supporting unit but insufficient to raise the annular foot from the surface;

means defining a substantially horizontally elongated connecting link rigidly connected to said boom supporting unit and having a longitudinal axis lying in a vertical plane containing said vertical axis; and means defining a powered steerable propelling unit connected to said link and controllable to selectively drive said heavy lift crane along a linear path parallel to said vertical plane, and to pivot the boom supporting unit horizontally about said vertical axis when said fluid supply means provides sufficient pressure within said low volume large area pressure chamber for supporting a sufficient portion of the weight acting on the boom supporting unit to slide said annular foot along said flat surface in response to movement of said powered steerable propelling unit from one position to another position.

* * * * *